US009627123B2

(12) United States Patent
Yoshizawa et al.

(10) Patent No.: US 9,627,123 B2
(45) Date of Patent: Apr. 18, 2017

(54) SOLENOID

(71) Applicant: AISIN SEIKI KABUSHIKI KAISHA, Kariya-shi (JP)

(72) Inventors: Naoya Yoshizawa, Anjo (JP); Kazuhiko Maeda, Anjo (JP); Takeshi Hayashi, Nagoya (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 0 days.

(21) Appl. No.: 14/947,199

(22) Filed: Nov. 20, 2015

(65) Prior Publication Data

US 2016/0148738 A1 May 26, 2016

(30) Foreign Application Priority Data

Nov. 25, 2014 (JP) ..... 2014-237871

(51) Int. Cl.
*H01F 7/13* (2006.01)
*H01F 7/16* (2006.01)
*H01F 7/08* (2006.01)

(52) U.S. Cl.
CPC ..... *H01F 7/1607* (2013.01); *H01F 7/081* (2013.01); *H01F 7/13* (2013.01); *H01F 2007/085* (2013.01)

(58) Field of Classification Search
CPC ..... F16K 31/06–31/10; H01F 7/081; H01F 2007/085; H01F 7/13
USPC ..... 335/129.01–129.22
See application file for complete search history.

(56) References Cited

U.S. PATENT DOCUMENTS 6,759,934 B2 * 7/2004 Bircann ..... H01F 7/081 251/129.15
2010/0301978 A1 * 12/2010 Ishibashi ..... H01F 7/1607 335/255
2011/0210277 A1 9/2011 Bender

* cited by examiner

*Primary Examiner* — Ramon M Barrera
(74) *Attorney, Agent, or Firm* — Oblon, McClelland, Maier & Neustadt, L.L.P.

(57) ABSTRACT

A solenoid includes: a coil wound around a bobbin; a case section accommodating the coil; a tubular yoke arranged on an inner circumferential portion of the coil; and a plunger arranged on an inner circumferential portion of the yoke, and moving from a start position along an axial direction of the yoke by magnetic attraction force generated in the yoke, wherein a diameter increasing portion whose diameter is increased from the start position toward a lower part in the axial direction is formed on an outer circumferential surface of the yoke, and the diameter increasing portion overlaps at least a part of a moving region of a lower-part side end portion of the plunger, and wherein an inner circumferential surface of the yoke guides the movement of the plunger and the yoke includes a contact member that regulates the movement of the plunger on the inner circumferential surface.

5 Claims, 4 Drawing Sheets

SOLENOID

CROSS REFERENCE TO RELATED APPLICATIONS

This application is based on and claims priority under 35 U.S.C. §119 to Japanese Patent Application 2014-237871, filed on Nov. 25, 2014, the entire contents of which are incorporated herein by reference.

TECHNICAL FIELD

This disclosure relates to a solenoid in which a plunger is moved by supplying electricity to a coil.

BACKGROUND DISCUSSION

Solenoids are used for a pressing operation of various devices such as a control valve. The solenoid includes a coil wound around a bobbin, a yoke, and a plunger in order from the outer side toward an inner circumferential side of a cylindrical case section. Magnetic attraction force is generated between the coil and the yoke by supplying electricity to the coil. The columnar plunger including an output shaft at the central portion is slidably moved along an axial direction of the yoke by being affected by the magnetic attraction force (refer to US2011/0210277A (Reference 1)).

In the solenoid in Reference 1, the yoke includes a tubular portion on an outer circumferential side of the plunger, a top plate portion formed on a tip end of the tubular portion in a radial direction, and a guide portion that is formed to extend from the top plate portion toward an outer circumferential side of the output shaft. The guide portion guides the movement of the plunger, and the sliding movement can be performed until a convex portion formed on an outer circumference of the output shaft comes into contact with an end of the guide portion. As described above, the solenoid in Reference 1 has a structure in which the output shaft of the plunger is guided by the yoke so as to move the plunger.

In the solenoid in Reference 1, since the yoke has the tubular portion, the top plate portion, and the guide portion, the structure becomes complex, and thus the processing becomes complex. In addition, the guide portion of the yoke guides the movement of the plunger, and regulates the movement of the plunger by coming into contact with an end face of the plunger. Since the guide portion does not contribute to generation of the magnetic attraction force, it is not reasonable that the guide portion is integrally formed with the tubular portion of the yoke via the top plate portion.

SUMMARY

Thus, a need exists for a solenoid which is not suspectable to the drawback mentioned above.

A feature of a solenoid according to an aspect of this disclosure resides in a configuration in which the solenoid includes a coil wound around a bobbin; a case section that accommodates the coil; a tubular yoke that is arranged on an inner circumferential portion of the coil; and a plunger that is arranged on an inner circumferential portion of the yoke, and is moved from a start position along an axial direction of the yoke by being affected by magnetic attraction force that is generated in the yoke when electricity is supplied to the coil, in which a diameter increasing portion whose diameter is increased from the start position of the plunger toward a lower part in the axial direction is formed on an outer circumferential surface of the yoke, the diameter increasing portion overlaps at least a part of a moving region of a lower-part side end portion of the plunger, and an inner circumferential surface of the yoke guides the movement of the plunger and the yoke includes a contact member that regulates the movement of the plunger on the inner circumferential surface.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

An embodiment of a solenoid disclosed here will be described below with reference to the drawings.

Figure 1:
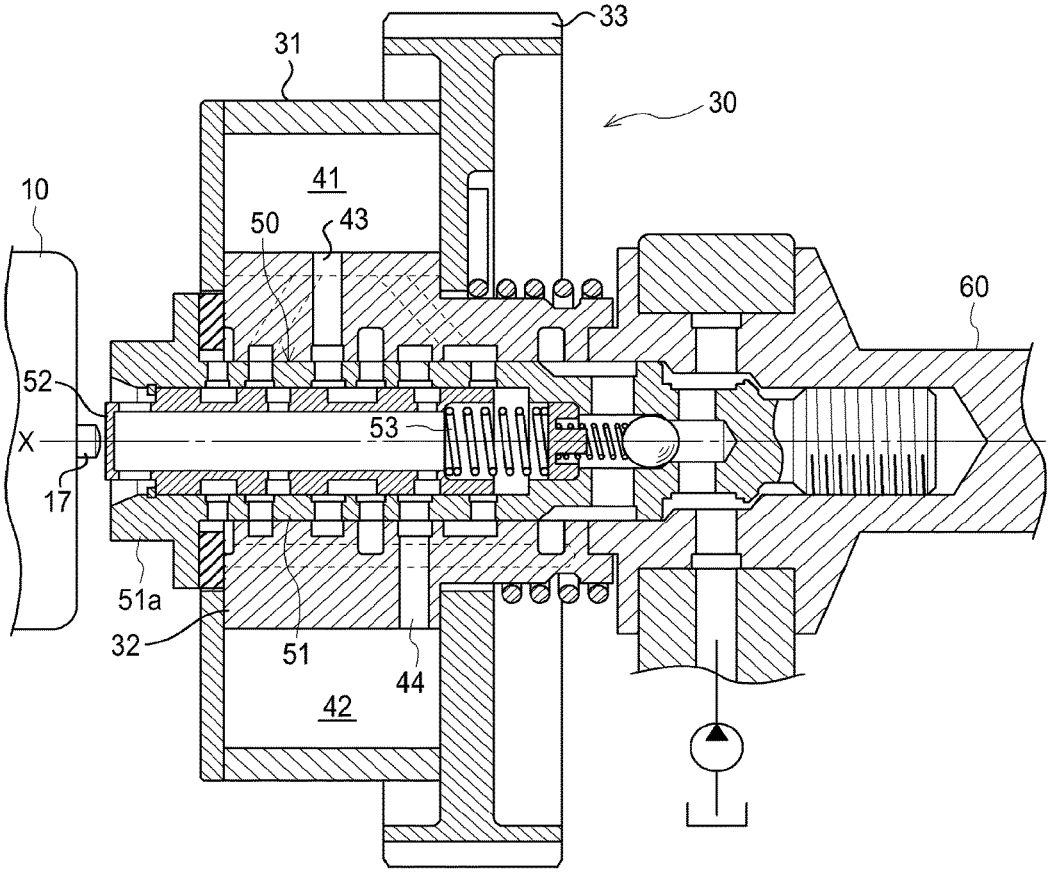
FIG. 1 is a diagram illustrating an example of use of a solenoid.

As illustrated in FIG. 1, a solenoid 10 is used as a driving unit of an oil control valve (OCV) 50 that distributes hydraulic oil to an advance chamber 41 or a retardation chamber 42 in a valve timing control device 30 of an automotive engine, for example.

The valve timing control device 30 includes a housing 31 that rotates in synchronization with a crankshaft (not illustrated), and an internal rotor 32 that is disposed in the housing 31 to be coaxial with an axial center X of the housing 31, and integrally rotates with a cam shaft 60.

The internal rotor 32 is fixed to the cam shaft 60 by using a fixing bolt 51. The housing 31 integrally includes a timing sprocket 33 to which a driving force is transmitted from the crankshaft. The internal rotor 32 is accommodated in the housing 31, and the advance chamber 41 and the retardation chamber 42 are formed as a fluid pressure chamber, between the housing 31 and the internal rotor 32. In the internal rotor 32, an advance flow path 43 communicating with the advance chamber 41 and a retardation flow path 44 communicating with the retardation chamber 42 are formed.

The OCV 50 is disposed in the internal rotor 32 to be coaxial with the axial center X. The OCV 50 is an example of an electromagnetic valve, and is configured to include the solenoid 10, the fixing bolt 51, a spool 52 that is inserted into the fixing bolt 51, and a spring 53. The spring 53 biases the spool 52 toward a head portion 51*a* of the fixing bolt 51. The OCV 50 changes the position of the spool 52 by the solenoid 10 to control supplying and discharging of the hydraulic oil with respect to the advance chamber 41 and the retardation chamber 42, and changes the relative rotational phase between the housing 31 and the internal rotor 32.

Figure 2:
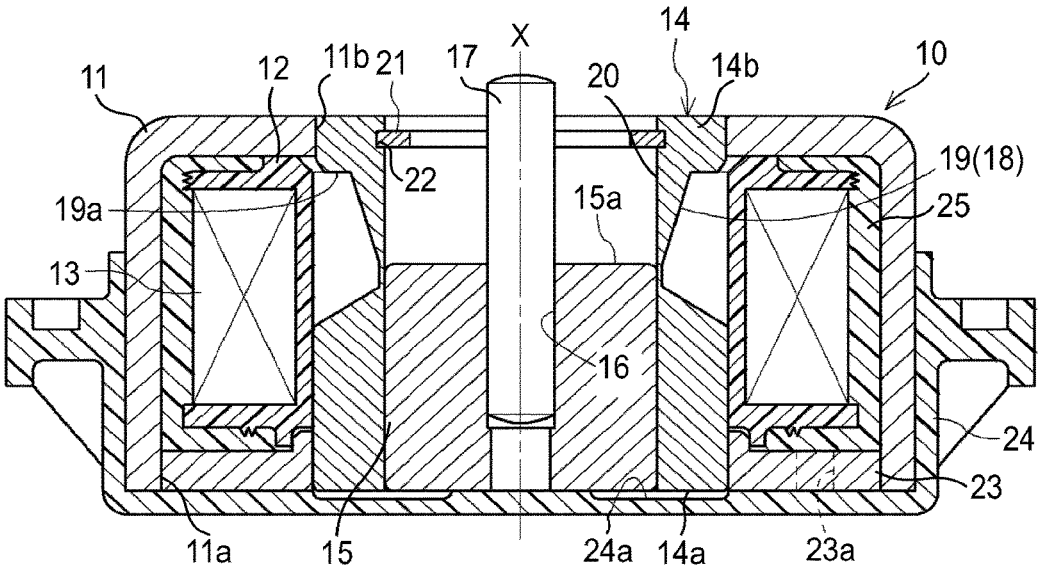
FIG. 2 is a cross-sectional view of the solenoid.

As illustrated in FIG. 2, in the solenoid 10, a coil 13 wound around a bobbin 12, a yoke 14, and a plunger 15 are accommodated in a case section 11 having an approximately cylindrical shape. The yoke 14 is arranged on an inner circumferential portion of the coil 13 and is formed to have a tubular shape. The plunger 15 is arranged on an inner circumferential portion of the yoke 14, and an output shaft 17 is press-fitted into a fitting hole 16 formed at the center thereof. The plunger 15 is affected by magnetic attraction force that is generated in the yoke 14 when electricity is supplied to the coil 13 and is moved from a start position (FIG. 2) along an axial direction X of the yoke 14.

Since an inner circumferential surface 20 of the yoke 14 is configured of a simple cylindrical surface, machining with respect to the inner surface of the yoke 14 becomes easy. In addition, the inner circumferential surface 20 of the yoke 14 guides the movement of the plunger 15. Accordingly, the plunger 15 can be smoothly moved. Since the yoke 14 does not have a part in contact with the plunger 15 in the axial direction X, the shape or the structure of the yoke becomes simple.

In order to generate the magnetic attraction force which is proper for the plunger 15, in the yoke 14, a cross-sectional portion with a great thickness is required at a portion separated from the start position of the plunger 15 in a lower part side so that the magnetic flux generated from the coil 13 easily passes therethrough. Meanwhile, at a portion in the vicinity of the start position of the plunger 15, a cross-sectional portion is required to have a small thickness in order to concentrate the magnetic force. Thus, a diameter increasing portion 19 whose diameter is increased from the start position of the plunger 15 toward the lower part in the axial direction X is formed on an outer circumferential surface 18 of the yoke 14. In this manner, it is possible to form desired magnetic flux by forming the diameter increasing portion 19 over the moving region of the plunger 15.

The coil 13 wound around the bobbin 12 and a plate member 23 of a magnetic substance having a though hole at the center are arranged inside a case section 11 in the axial direction X. An opening portion 11*a* of the case section 11 on the side of the plate member 23 is closed by a cover portion 24 made of a resin. The cover portion 24 is integrally formed with a resin portion 25 around the bobbin 12. A flow hole 23*a* which causes the cover portion 24 and the resin portion 25 to communicate with each other is formed on the plate member 23. A concave portion 24*a* is formed at a portion facing the yoke 14 and the plunger 15 on the cover portion 24. The concave portion 24*a* is formed in the circumferential direction so as to surround the center portion of the cover portion 24.

Since the yoke 14 protects the thin portion of the diameter increasing portion 19, the yoke 14 is inserted into the case section 11 without being deformed when being pressed into the inner circumferential side of the bobbin 12, and a lower-part side end portion 14*b* is fitted into a hole portion 11*b* so as to be fixed to the case section 11. An upper-part side end surface 14*a* of the yoke 14 does not come into contact with the concave portion 24*a*. Therefore, it is possible to avoid an impact due to the contact between the yoke 14 and the cover portion 24. The yoke 14 is held by the resin portion 25.

Figure 3:
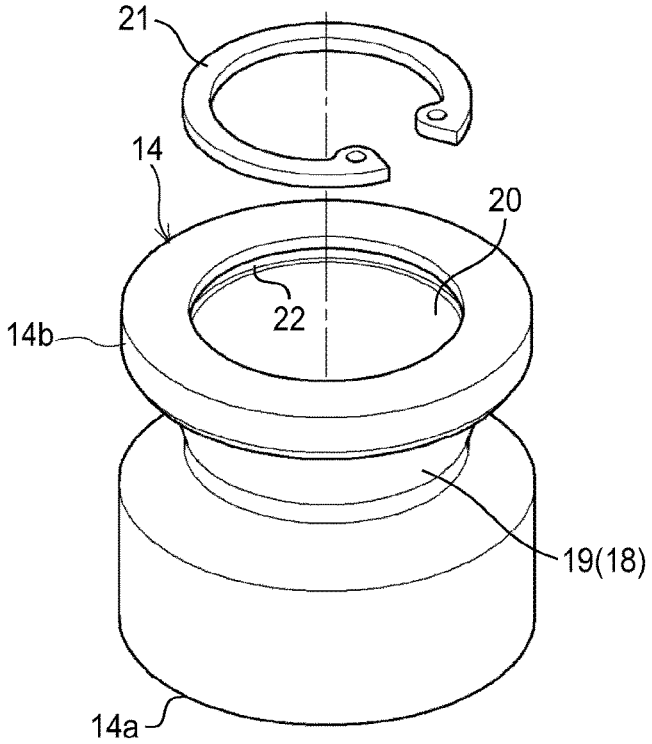
FIG. 3 is an exploded perspective view of a yoke and a contact member.
Figure 4:
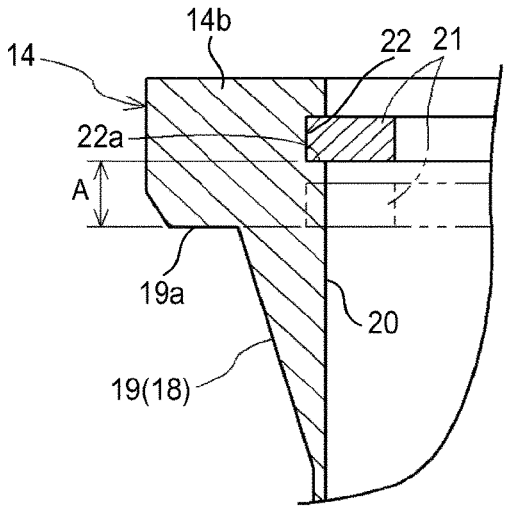
FIG. 4 is a cross-sectional view illustrating main parts of the solenoid.

As illustrated in FIGS. 2 to 4, a contact member 21 that regulates the movement of the plunger 15 is provided on the inner circumferential surface 20 of the yoke 14. The contact member 21 is engaged with an annular groove portion 22 formed on the inner circumferential surface 20 of the yoke 14 in the circumferential direction. In this manner, the yoke 14 can appropriately regulate the movement of the plunger 15 while having a simple structure of including the annular groove portion 22. In addition, when the annular groove portion 22 is formed, it is easy to change the processing position with respect to the yoke 14, and it is easy to determine an optimal regulation position of the plunger 15.

In the embodiment, the contact member 21 is configured of a snap ring. If the contact member 21 is a snap ring, the positioning of the contact member 21 and the groove portion 22 in the circumferential direction is not necessary, and the contact member 21 is easily engaged with the groove portion 22 only by being pressed toward the inner circumferential surface 20 of the yoke 14.

The plunger 15 is configured to be movable until a lower-part side end portion 15*a* in the axial direction X as the moving direction comes into contact with the contact member 21. The movement of the plunger 15 is regulated by the contact member 21, and thus the stroke of the output shaft 17 is adjusted. The position of the contact member 21 included in the yoke 14 is arbitrarily set in the axial direction X, and thus it is possible to easily adjust the stroke of the plunger 15. In the embodiment, the moving region of the spool 52 in the OCV 50 is set to be shorter than the stroke of the plunger 15. Therefore, the movement of the plunger 15 is regulated by the spool 52 without causing the plunger 15 to come into contact with the contact member 21.

The diameter increasing portion 19 overlaps at least a part of the moving region of the lower-part side end portion 15*a* of the plunger 15. The moving region of the lower-part side end portion 15*a* of the plunger 15 is a region from an initial position illustrated in FIG. 2 to the contact member 21 in the axial direction X. In the embodiment, the diameter increasing portion 19 overlaps a region from the initial position of the lower-part side end portion 15*a* to an upper part position (lower direction of the paper surface in FIG. 2) of the contact member 21.

Figure 5:
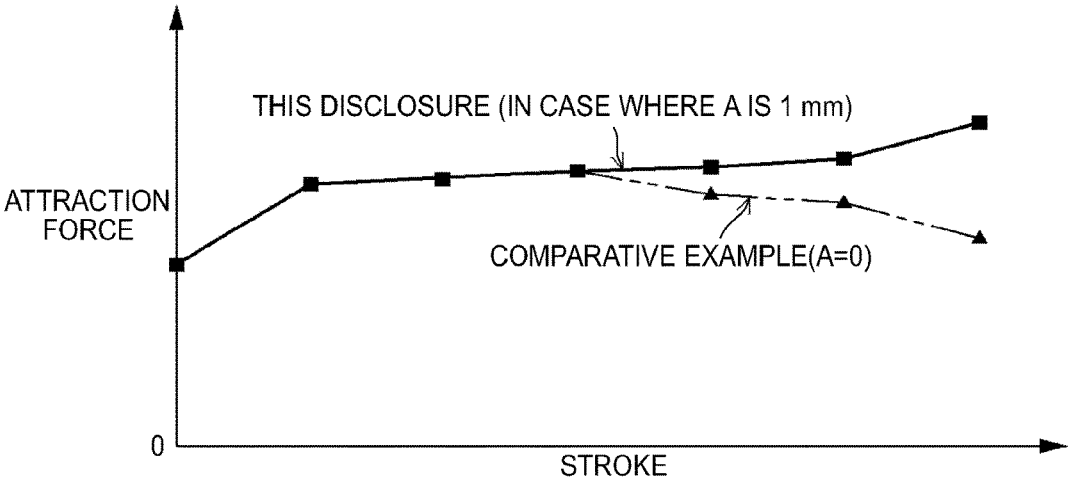
FIG. 5 is a graph illustrating a relationship between magnetic attraction force and a stroke of a plunger.

As illustrated in FIGS. 2 and 4, the groove portion 22 is provided at a position on a lower part side further than a lower-part side end portion 19*a* of the diameter increasing portion 19. FIG. 5 illustrates the magnetic attraction force that changes with respect to the stroke of the plunger 15 in a case where a distance A between the position of the lower-part side end portion 19*a* of the diameter increasing portion 19 and the position of an upper-part side end portion 22*a* of the groove portion 22 changes. The stroke of the plunger 15 illustrated in FIG. 5 is from the start position (left end) to the lower-part side end portion 19*a* (right end) of the diameter increasing portion 19.

As illustrated in FIG. 5, in a case where the distance A is zero, the magnetic attraction force is decreased as the stroke of the plunger 15 becomes long. Therefore, in the latter half of the moving region, the movement of the plunger 15 becomes unstable. Meanwhile, in a case where the distance A is 1 mm, the magnetic attraction force is slightly increased when the plunger 15 is moved up to the trailing end of the stroke. Accordingly, even in the latter half of the moving region, it is possible to stably move the plunger 15.

In order to make the moving speed of the plunger 15 uniform, it is preferable to make the magnetic attraction force uniform. Thus, according to the shape of the yoke 14, that is, the length of the diameter increasing portion 19 in the direction of the stroke, it is possible to adjust the magnetic attraction force by changing the shape or the position of the groove portion 22.

Other Embodiments (1) In the graph of FIG. 5, at the trailing end of the stroke of the plunger 15, the magnetic attraction force is increased in a case where A is 1 mm, and the magnetic attraction force is decreased in a case where A is zero.

Figure 6:
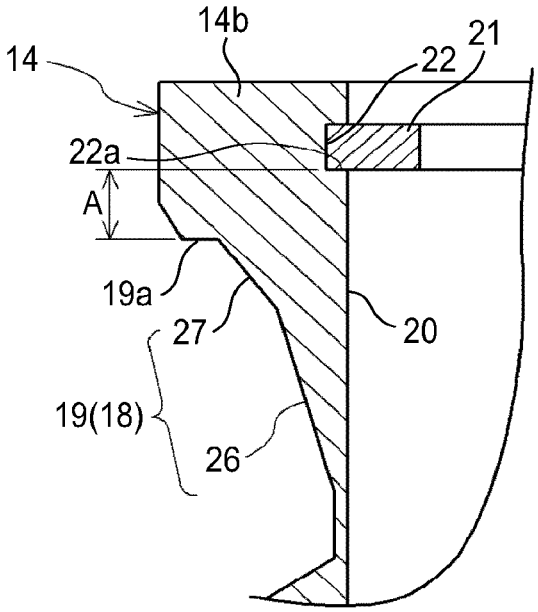
FIG. 6 is a cross-sectional view illustrating main parts of a solenoid according to another embodiment.

Here, in order to adjust the magnetic attraction force at the trailing end of the stroke of the plunger 15, the inclination angle of the diameter increasing portion 19 may be changed in two steps as illustrated in FIG. 6. In FIG. 6, as an example, the inclination angle of a second region 27 on the lower part side is set to be gentler than the inclination angle of a first region 26 on the upper part side of the diameter increasing portion 19. In doing so, in the region of the trailing end of the stroke of the plunger 15, the thickness of the cross-sectional portion of the yoke 14 is greatly increased so that the magnetic flux easily passes therethrough, and thus it is possible to prevent the magnetic attraction force from being degraded. In this manner, in the latter half of the moving region of the plunger 15, it is possible to adjust the magnetic attraction force by changing an increasing rate of the thickness of the cross-sectional portion of the yoke 14.

Figure 7:
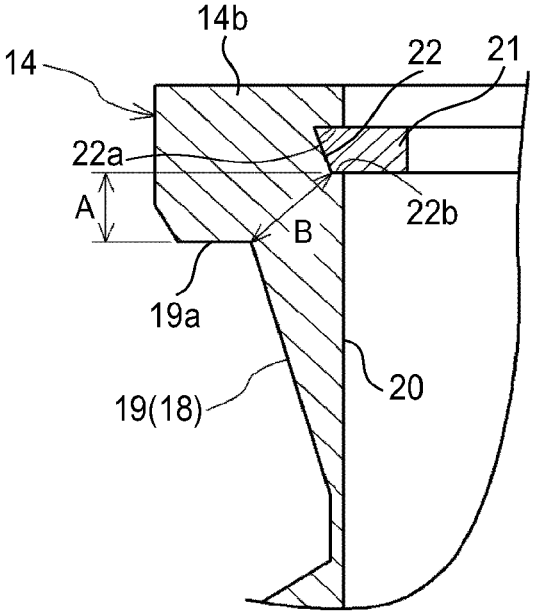
FIG. 7 is a cross-sectional view illustrating main parts of a solenoid according to still another embodiment.

As illustrated in FIG. 7, the shape of the groove portion 22 may be changed, for example, the upper part side end portion 22*a* of the groove portion 22 of the yoke 14 is shallower than a lower part side end portion 22*b* thereof. In doing so, since a distance B between the groove portion 22 and the lower-part side end portion 19*a* of the diameter increasing portion 19 is secured to be long, it is possible to prevent the width of the cross section of a member through which the magnetic flux passes from being excessively decreased, and it is possible to prevent the magnetic attraction force from being degraded.

(2) In the above-described embodiment, an example in which the annular groove portion 22 is formed on the inner circumferential surface 20 of the yoke 14 in the circumferential direction is described. However, the groove portion 22 may be partially or dispersively formed in the circumferential direction. In this case, the contact member 21 is configured to have an appropriate shape so as to be engaged with the groove portion 22.

(3) In the above-described embodiment, an example in which the solenoid 10 is used in the OCV 50 which is the solenoid valve is described. However, the solenoid 10 may be used in devices other than the solenoid valve.

This disclosure can be widely used in a solenoid used for a pressing operation of various devices.

A feature of a solenoid according to an aspect of this disclosure resides in a configuration in which the solenoid includes a coil wound around a bobbin; a case section that accommodates the coil; a tubular yoke that is arranged on an inner circumferential portion of the coil; and a plunger that is arranged on an inner circumferential portion of the yoke, and is moved from a start position along an axial direction of the yoke by being affected by magnetic attraction force that is generated in the yoke when electricity is supplied to the coil, in which a diameter increasing portion whose diameter is increased from the start position of the plunger toward a lower part in the axial direction is formed on an outer circumferential surface of the yoke, the diameter increasing portion overlaps at least a part of a moving region of a lower-part side end portion of the plunger, and an inner circumferential surface of the yoke guides the movement of the plunger and the yoke includes a contact member that regulates the movement of the plunger on the inner circumferential surface.

In this configuration, since the yoke has a tubular shape and the inner circumferential surface guides the movement of the plunger, the plunger can be smoothly moved. In addition, the yoke includes the contact member that regulates the movement of the plunger on the inner circumferential surface. In this aspect, it is not necessary for the yoke itself to have a function of regulating the movement of the plunger, and thus the shape or the structure becomes simple. Since the position of the contact member included in the yoke is arbitrarily determined in the moving direction of the plunger, the degree of freedom for designing the yoke becomes increased.

Another feature of the solenoid according to the aspect of this disclosure resides in a configuration in which an annular groove portion is formed on the inner circumferential surface of the yoke in a circumferential direction, and the contact member is engaged with the groove portion.

As in this configuration, by causing the contact member to be engaged with the annular groove portion formed on the inner circumferential surface of the yoke in the circumferential direction, the yoke can appropriately regulate the movement of the plunger while having a simple structure of including the annular groove portion. In addition, when the annular groove portion is formed, it is easy to change the processing position with respect to the yoke, and it is easy to determine an optimal regulation position of the plunger.

Another feature of the solenoid according to the aspect of this disclosure resides in a configuration in which the groove portion is provided at a position on a lower part side further than the lower-part side end portion of the diameter increasing portion in the axial direction in which the plunger is moved.

In order to generate the magnetic attraction force which is proper for the plunger, in the yoke, a cross-sectional portion with a great thickness is required at a portion separated from the start position of the plunger in a lower part side so that the magnetic flux generated from the coil easily passes therethrough. Meanwhile, at a portion in the vicinity of the start position of the plunger, a cross-sectional portion is required to have a small thickness in order to concentrate the magnetic force. Therefore, it is possible to form desired magnetic flux by forming the diameter increasing portion over the moving region of the plunger. However, when the groove portion is formed on the inner circumferential surface of the yoke in order to attach the contact member, the cross section of a member at that portion becomes narrow and thus the magnetic flux may be decreased. In this case, the magnetic attraction force is degraded and thus the moving operation of the plunger becomes unstable.

Here, in this configuration, the groove portion is provided at a position on a lower part side further than a lower-part side end portion of the diameter increasing portion in the axial direction in which the plunger is moved. In doing so, a portion in which the width of the cross section of the member becomes narrow is positioned on the lower part side further than the lower-part side end portion of the diameter increasing portion. Accordingly, since the magnetic field is soundly formed and the magnetic attraction force is maintained, the moving operation of the plunger becomes stabilized.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A solenoid comprising:

a coil wound around a bobbin;

a case section that accommodates the coil;

a tubular yoke that is integrally provided and arranged on an inner circumferential portion of the coil; and a plunger that is arranged on an inner circumferential portion of the yoke, and is moved from a start position along an axial direction of the yoke by a magnetic attraction force that is generated in the yoke when electricity is supplied to the coil, wherein a diameter increasing portion whose the diameter is increased from the start position of the plunger toward a lower part in the axial direction is formed on an outer circumferential surface of the yoke, and the diameter increasing portion overlaps at least a part of a moving region of a lower-part side end portion of the plunger, wherein an inner circumferential surface of the yoke directly guides the movement of the plunger and the yoke includes a contact member that regulates the movement of the plunger on the inner circumferential surface, and wherein an annular groove portion is formed on the inner circumferential surface of the yoke in a circumferential direction, and the contact member is engaged with the annular groove portion.

2. The solenoid according to claim 1, wherein the annular groove portion is provided at a position on a lower part side farther than a lower-part side end portion of the diameter increasing portion in the axial direction in which the plunger is moved.

3. The solenoid according to claim 1, wherein the contact member is a snap ring.

4. The solenoid according to claim 1, wherein the annular groove portion is provided outside on the inner circumferential surface of the yoke at a portion where the plunger is slidably in contact with the inner circumferential surface.

5. The solenoid according to claim 1, wherein the inner circumferential surface of the yoke is a constant cylindrical surface that directly guides the movement of the plunger where the plunger is slidably in contact with the inner circumferential surface.

* * * * *